US009862082B2

(12) United States Patent
Moore

(10) Patent No.: US 9,862,082 B2
(45) Date of Patent: Jan. 9, 2018

(54) REMOVAL AND INSTALLATION DEVICE FOR VALVE KEEPERS

(71) Applicant: Randall Moore, Torrance, CA (US)

(72) Inventor: Randall Moore, Torrance, CA (US)

( * ) Notice: Subject to any disclaimer, the term of this patent is extended or adjusted under 35 U.S.C. 154(b) by 20 days.

(21) Appl. No.: 14/848,150

(22) Filed: Sep. 8, 2015

(65) Prior Publication Data

US 2016/0067854 A1 Mar. 10, 2016

Related U.S. Application Data

(60) Provisional application No. 62/047,554, filed on Sep. 8, 2014.

(51) Int. Cl.
*B25B 27/26* (2006.01)
*B25B 27/24* (2006.01)

(52) U.S. Cl.
CPC ..... *B25B 27/26* (2013.01); *B25B 27/24* (2013.01); *Y10T 29/53817* (2015.01)

(58) Field of Classification Search
CPC . B23P 19/04; B25B 1/00; B25B 27/24; B25B 27/26
USPC ..... 29/249
See application file for complete search history.

(56) References Cited

U.S. PATENT DOCUMENTS 2,434,456 A * 1/1948 Cook ..... B25B 27/26 29/215
3,314,136 A * 4/1967 Giles ..... B25B 27/24 29/249
3,315,339 A * 4/1967 Young ..... B25B 27/24 29/249
3,392,434 A * 7/1968 Giles ..... B25B 27/24 29/249
3,564,697 A * 2/1971 Shalaty et al. ..... B25B 27/24 29/249
3,693,484 A * 9/1972 Sanderson, Jr. ..... B25B 13/48 403/325
3,793,999 A * 2/1974 Seiler ..... B23P 19/045 123/90.28
4,095,324 A * 6/1978 Lawson ..... B25B 27/24 29/249
4,667,388 A * 5/1987 Browning ..... B23P 19/045 29/249
5,761,785 A * 6/1998 Connolly ..... B23P 19/045 269/21
5,915,740 A * 6/1999 Weitner ..... B23P 19/045 29/213.1
6,029,340 A * 2/2000 Bramante ..... B23P 19/045 29/249
6,219,896 B1 * 4/2001 Levy ..... B25B 27/24 29/214
6,223,426 B1 5/2001 Kimmelmann et al.
6,233,426 B1 5/2001 Lee et al.
(Continued)

FOREIGN PATENT DOCUMENTS

EP 1488890 A1 12/2004

*Primary Examiner* — Larry E Waggle, Jr.
*Assistant Examiner* — Tyrone V Hall, Jr.

(57) ABSTRACT

A tool for installing or removing valve keepers is disclosed. One end of the tool is configured to easily remove valve keepers, while the other end of the tool is configured to easily install valve keepers. This valve tool can be further connected to an engine-mounted lever assembly for increasing leverage on the tool during use.

16 Claims, 11 Drawing Sheets

(56) References Cited

U.S. PATENT DOCUMENTS

| | | | | |
|---|---|---|---|---|
| 6,473,965 | B2 * | 11/2002 | Levy | B25B 27/24 29/214 |
| 8,726,476 | B2 * | 5/2014 | Renaker | B60C 25/18 29/221.5 |
| 8,819,909 | B2 * | 9/2014 | Alvarez | B23P 19/045 123/90.28 |
| 9,144,898 | B1 * | 9/2015 | Davis, Jr. | B25B 27/26 |
| 9,180,592 | B2 * | 11/2015 | Sueoka | B23P 19/001 |
| 9,278,439 | B1 * | 3/2016 | Krause | B25B 27/24 |
| 9,364,929 | B1 * | 6/2016 | Sismanoglu | B23P 19/048 |
| 9,387,576 | B1 * | 7/2016 | Davis, Jr. | B25B 27/24 |
| 2009/0044391 | A1 * | 2/2009 | Duarte | B25B 27/24 29/215 |

* cited by examiner

REMOVAL AND INSTALLATION DEVICE FOR VALVE KEEPERS

RELATED APPLICATIONS

This application claims priority to U.S. Provisional Application Ser. No. 62/047,554 filed Sep. 8, 2014 entitled Removal and Installation Device for Valve Keepers, which is hereby incorporated herein by reference in its entirety.

BACKGROUND OF THE INVENTION

Combustion engines in most vehicles rely on reciprocating poppet valves, which open and close at precise moments to either allow fuel mixture into an engine's cylinder or allows spent gases to escape. These control valves are typically spring-loaded by a valve spring for automatic return into the closed position and are stressed between a reference support structure of the valve, generally a cylinder head, and a valve spring plate or spring retainer axially held to the valve stem. Specially shaped holding keepers (also referred to as keys or collets) are mounted between a suitable surface in the spring retainer and annular, mating grooves on the valve stem, connecting the valve member to the spring.

SUMMARY OF THE INVENTION

In one embodiment of the present invention, a valve tool is described, having a first end configured to remove valve keepers from a valve stem and a second end configured to install valve keepers to a valve stem.

In another aspect of the present invention, a valve tool is described having a keeper removal end comprising a tool body having a cavity containing one or more magnets. The cavity and its opening are sized to accommodate a valve stem and valve keepers. The one or more magnets are positioned so as to attract the keepers when the tool is depressed over the valve stem.

In another aspect of the present invention, a valve tool is described having a keeper installation end comprising a spring-biased centering pin located within a cavity of the tool body. At its end, a removable end cap is attached which includes two semi-circular channels for the placement of the valve keepers. The end cap also has a passage that is aligned with the opening of the cavity of the tool body, allowing the centering pin to reciprocally move through. When the centering pin is aligned over a valve stem and the tool is depressed (e.g., via a lever assembly), the valve spring is depressed, the centering pin is pushed at least partially back into the tool body cavity, and the mating features of the keepers are aligned along the annular rings of the valve stem. As the tool is withdrawn, the keepers engage the annular rings of the valve stem, allowing the valve's spring retainer to engage both the spring and the valve stem.

Another embodiment of the present invention is directed to a method of installing or removing valve keepers with a tool.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
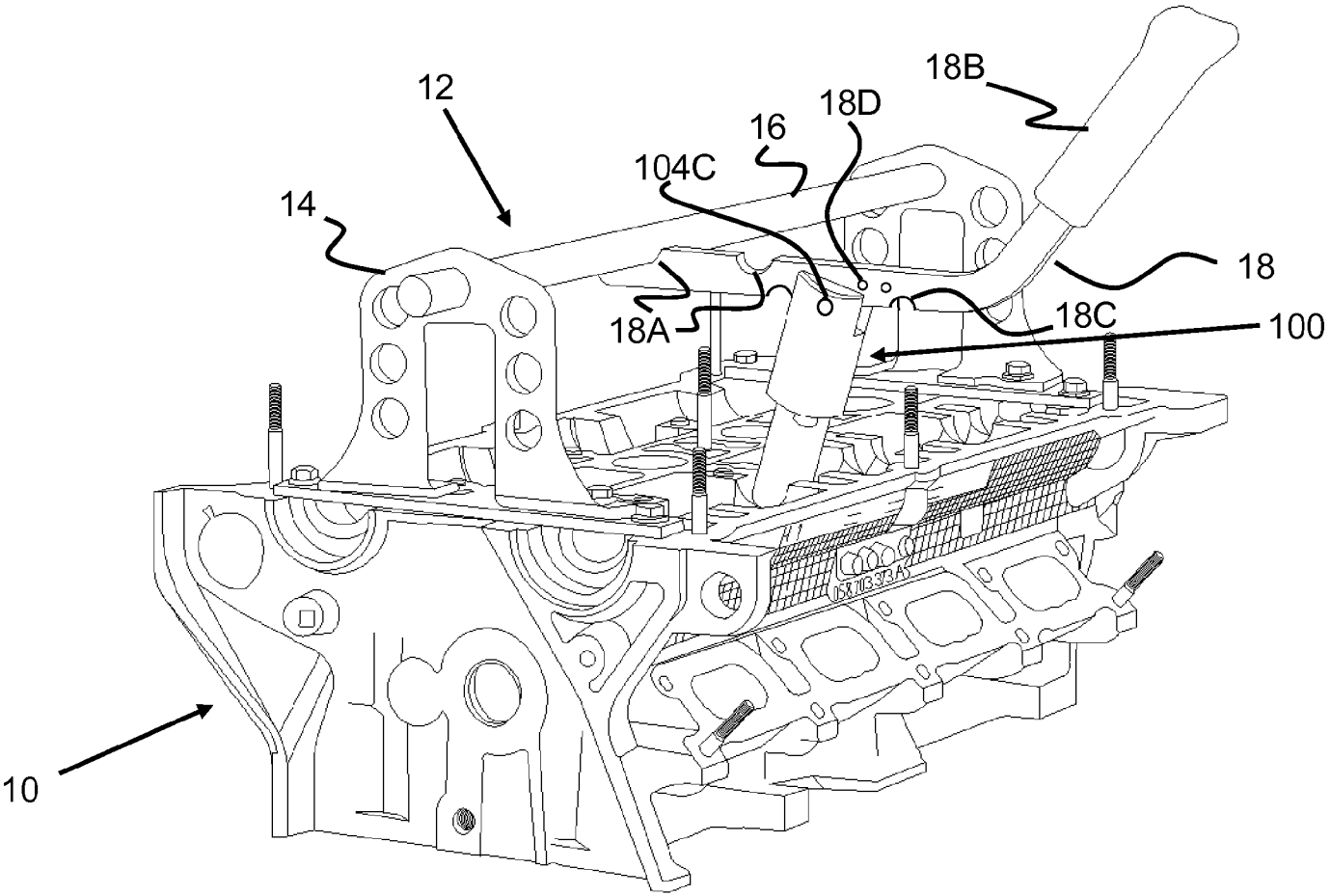
FIG. 1 is a perspective view of a cylinder head and a lever assembly for a valve tool.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The embodiments of the present invention are directed to a tool for the removal and installation of valve spring keepers (also referred to as keys or collets) from an internal combustion engine's cylinder head valve assembly. These keepers are generally difficult to install or remove with other tools available. However, the tool embodiment of the present invention allows for quicker, simpler, and more reliable installation/removal of the keepers over prior techniques, greatly reducing labor time and further allowing use by even relatively inexperienced mechanics. The tool of the present invention is especially useful for installation and removal of multi-grooved keepers (e.g., keepers with bulges that engage with valve stems having a plurality of annular rings, such as three annular grooves). One aspect of this functionality is the ability to depress the valve spring to such a depth so as to align the keeper's bulges with the annular rings without getting hung up during the tool's movement.

FIG. 1 illustrates a perspective view of a cylinder head 10 with a valve keeper tool 100 located above the cylinder head and over a poppet valve assembly. In one embodiment, the tool 100 can be used on its own by pressing down on the spring of the poppet valve, as described later in this specification. Preferably, the tool 100 can be connected to a lever adapter assembly 12 to provide the user with leverage to facilitate the keeper installation or removal. In the example of FIG. 1, the lever adapter includes two support members 14 that connect to the engine block and support a rod 16. A lever member 18 has one or more semi-circular channels or grooves 18A on its upper side for engaging the rod 16, as well as a handle 18B for allowing the user to pull downwards. The tool 100 can be connected to the lever member 18 via the lower grooves 18C or via the apertures 18D.

Figure 2:
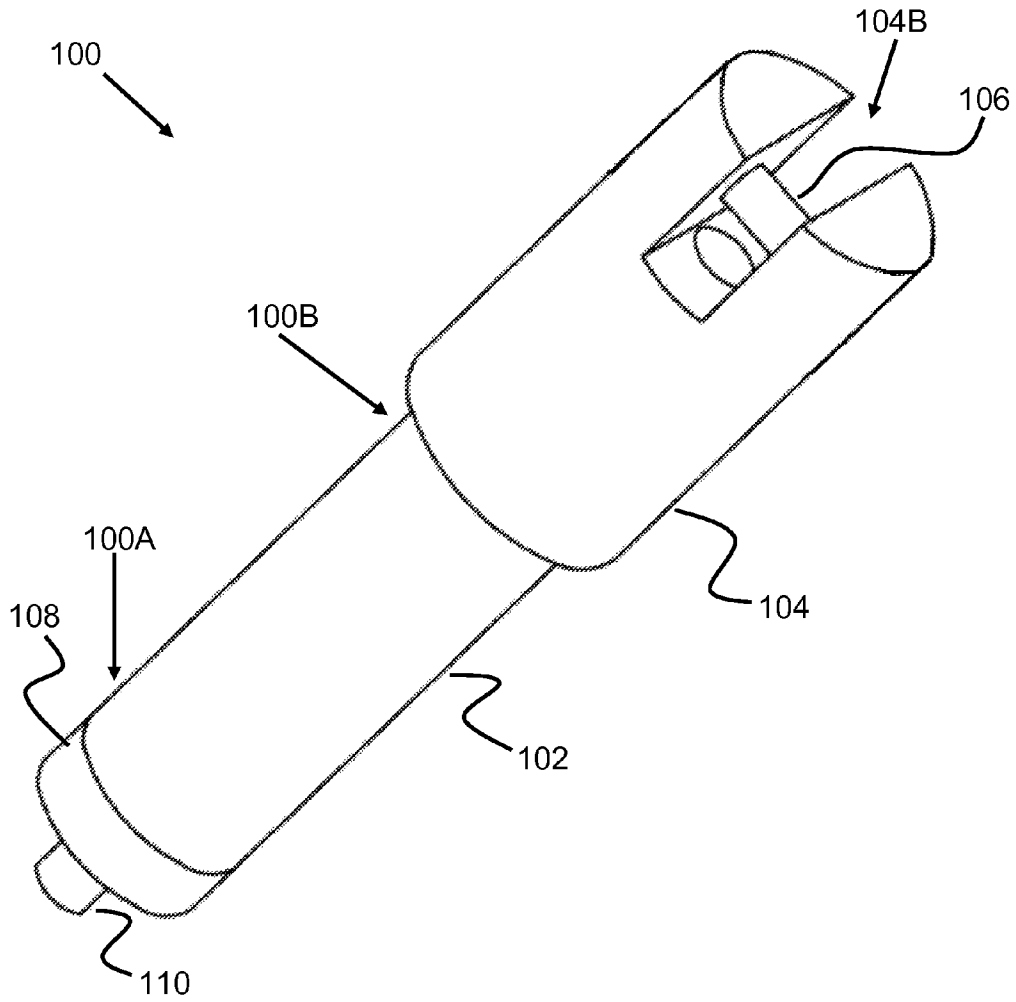
FIG. 2 is a perspective view of a valve tool.
Figure 3:
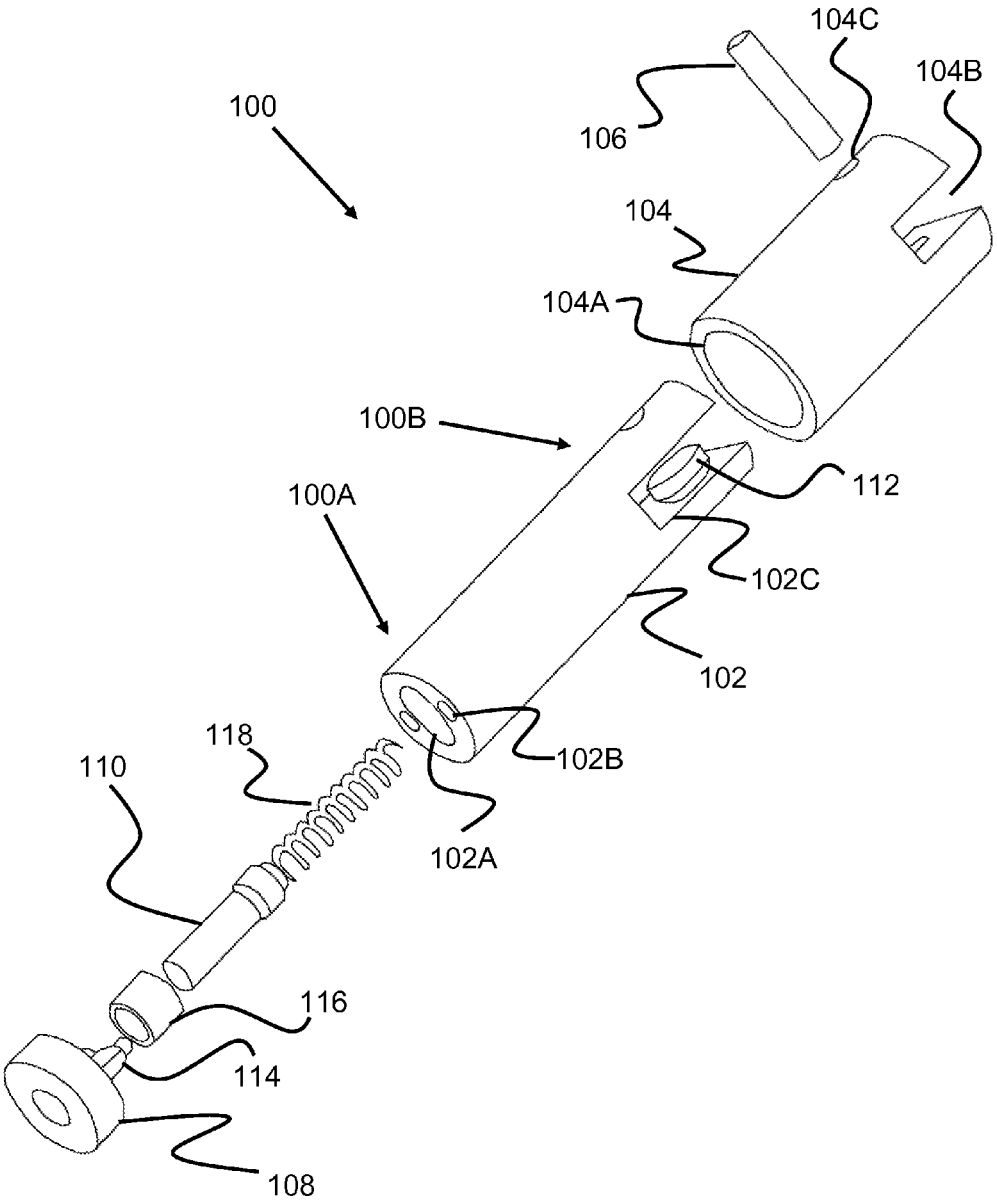
FIG. 3 is an exploded view of the valve tool of FIG. 2.

As best seen in FIGS. 1, 2, and 3, the tool 100 includes a lever adapter 104 that can be removed and/or frictionally connected to either end of the body 102 of the tool 100 via opening 104A. The adapter 104 includes a lever channel 104B, a lever pin 106, and lever pin apertures 104C. The lever pin apertures 104C are sized and oriented to allow the pin 106 to pass through in a generally perpendicular orientation relative to the channel 104B. The lever member 18 preferably includes an aperture through it that is sized to accept the pin 106, thereby allowing the pin 106 to pivotally engage the adapter 104 and lever member 18. Hence, the user can pull down on the lever member 18 to apply downward force on the tool 100 that may otherwise be especially difficult due to stiffness of the valve spring. It should also be noted that other movement mechanisms for the tool 100 are also possible, such as a mechanical gear, hammer, or pneumatic valve spring compressor.

As seen best in FIGS. 2 and 3, the tool 100 has an installation end 100A that is configured for installing valve keepers 20, and a removal end 100B that is configured for removing valve keepers 20. Depending on which task the user is interested in performing, the lever adapter 104 can be removed from one end of the tool 100 and placed over the unused end.

Referring first to the valve keeper removal end 100B, this region includes a channel 102C (or alternately a partially enclosed cavity) that contains two magnets 112 (alternately one large magnet or a plurality of magnets). As described in further detail below, when the tool 100 is moved downward, compressing the valve spring 24, the magnets each attract one of the keepers 20 that were previously engaged with the annular rings 26A at the top of the valve stem 26.

Turning to the valve keeper installation end 100A, the tool body 102 includes a cavity 102A in which a spring 118 and centering pin 110 is located. The centering pin 110 has a generally cylindrical shape with a bottom end having a recess 110A to accept or engage the valve stem for centering. The top end of the centering pin 110 includes a larger diameter portion, which is prevented from passing through a sleeve 116 that is fixed at the opening of the cavity 102A, while being sized to allow the lower portions of the pin 110 to move back and forth. Hence, the pin 110 is downwardly or outwardly biased by the spring 118 without being completely ejected from the cavity 102A, as further seen in FIG. 4.

Figure 5A:
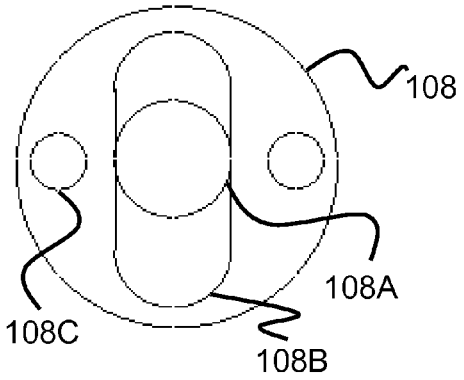
FIGS. 5A-5D are various views of an end cap member of the valve tool of FIG. 2.
Figure 5B:
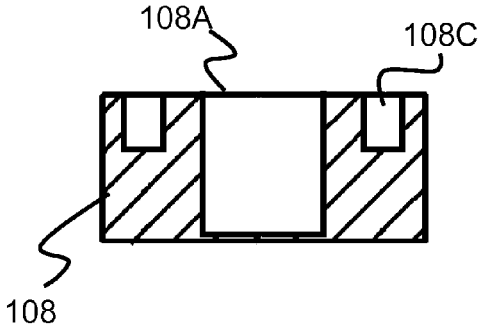
Figure 5C:
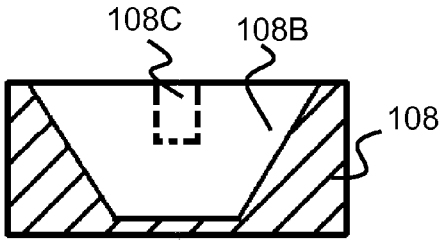
Figure 5D:
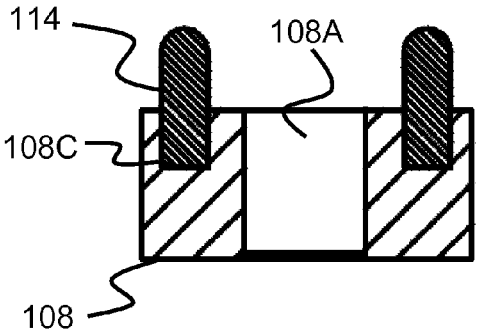

The installation end 100A also includes a user-removable end portion 108 that can be loaded with two keepers 20 prior to installation. FIG. 5A illustrates a top view of the end portion 108 while FIGS. 5B, 5C, and 5D illustrate various cross sectional views of the end portion 108. The end portion 108 includes two channels, cavities, or recesses 108B (preferably semi-circular in shape) that have a generally downward slope towards the center aperture 108A. Each of the recesses 108B are loaded with a keeper 20, such that the rounded, annular-ring engaging portions are facing the pin 110, once the end portion 108 is connected to the tool body 102. As best seen in FIGS. 3 and 5D, the end portion 108 can be connected to the tool body 102 via pins 114 that engage pin holes 108C and 102B. As described in detail below, as the tool 100 is pressed down, the centering pin 110 is depressed, allowing the keepers 20 to engage the annular rings 26A of the valve stem 26.

Figure 4:
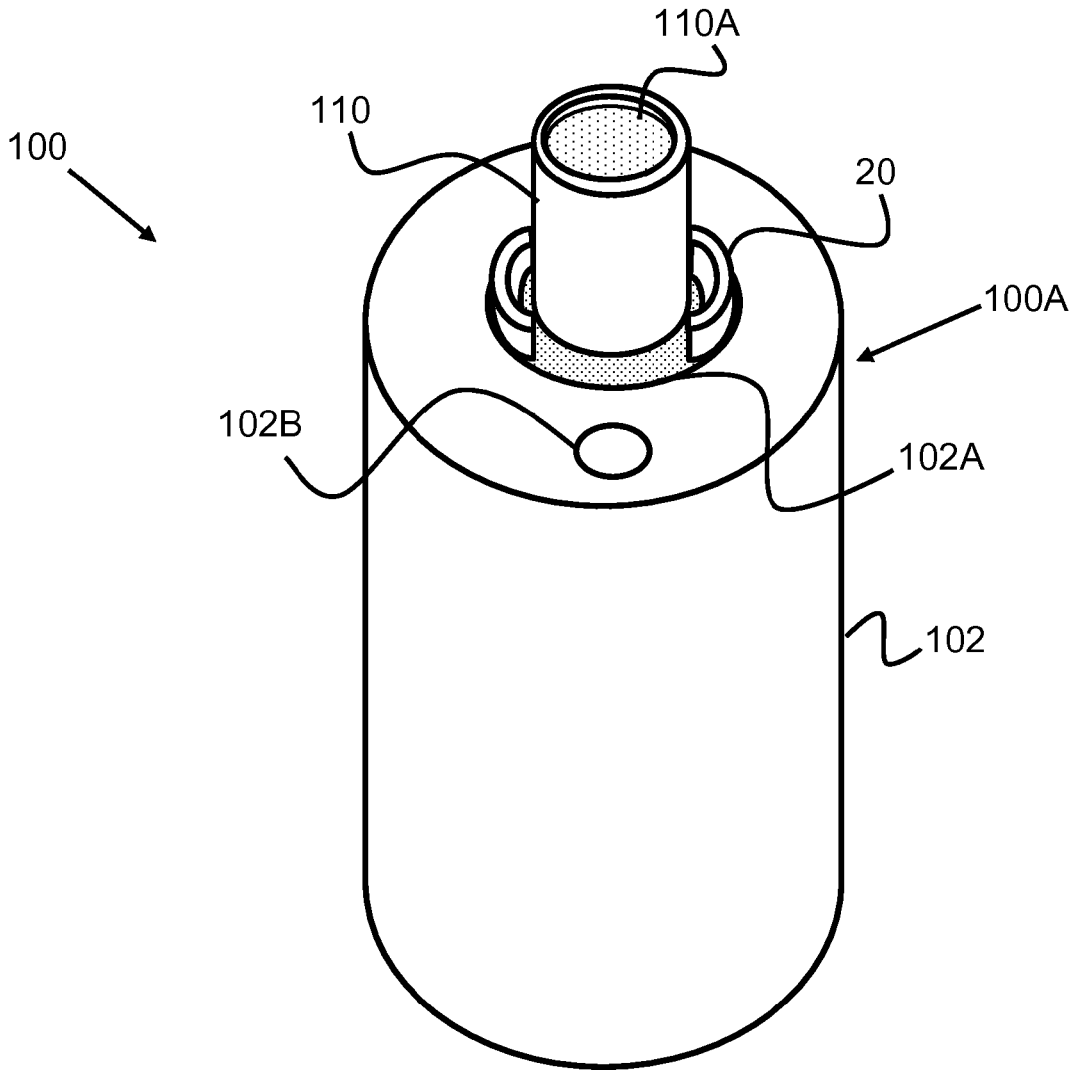
FIG. 4 is a perspective view of an end of the valve tool of FIG. 2 without the end cap.
Figure 6B:
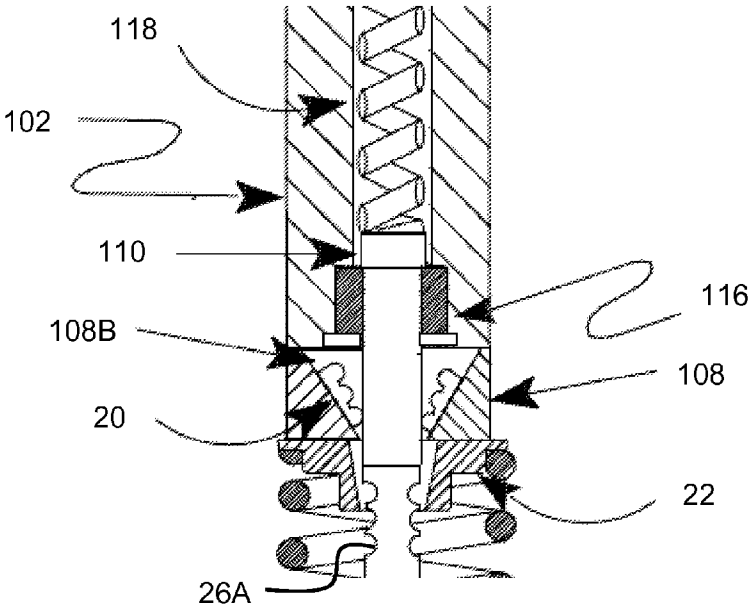
FIGS. 6A-8B are various views of the valve tool of FIG. 2 during a procedure to install valve keepers to a valve stem.
Figure 6A:
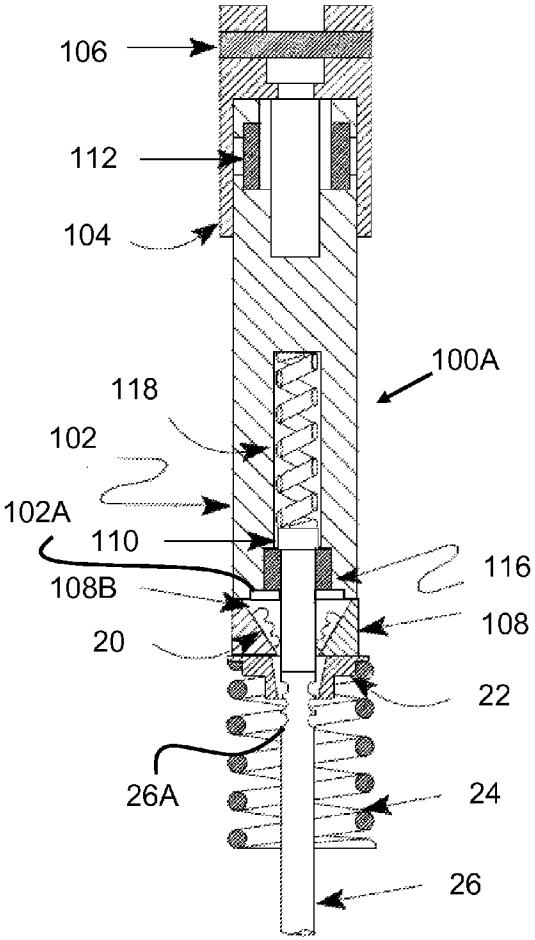

FIGS. 4 and 6A through 8B illustrate various, detailed steps for using the installation end 100A of the tool 100 for installing keepers 20 on the annular rings 26A of a valve stem 26. Referring first to FIG. 4, the end portion 108 is removed from the tool and the keepers 20 are placed in a top recessed portion of the cavity 102A on opposite sides of the centering pin 110 and with their small ends facing upwards. As seen in FIG. 6A and the magnified view in FIG. 6B, the tool 100 is flipped over, causing the two keepers 20 to fall into the two recesses or channels 108B of the end portion 108, and the end portion 108 is connected to the end of the tool body 102. Next, the tool 100, which is preferably connected to the lever adapter assembly 12 as previously described, is depressed onto the valve, first contacting the top of the valve stem 26 with the bottom recess of the centering pin 110. As the depression continues, the centering pin 110 begins moving into the cavity 102A, compressing spring 118, until the bottom surface of the end portion 108 contacts the spring keeper 22 of the valve.

Figure 7B:
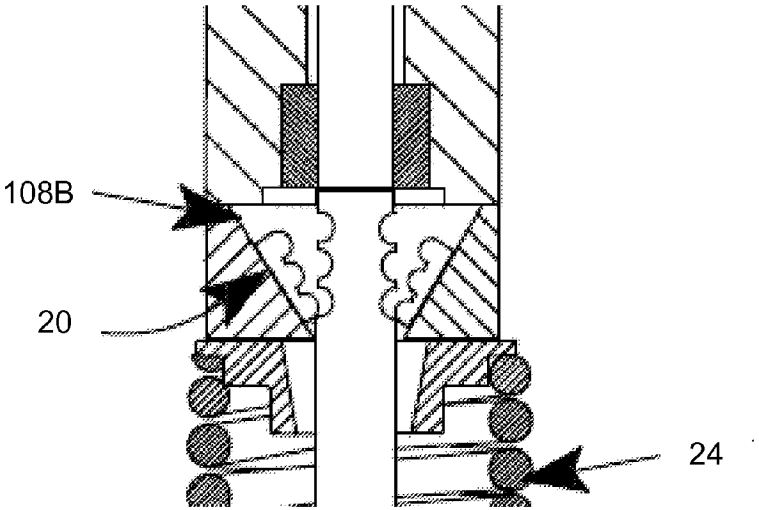
Figure 7A:
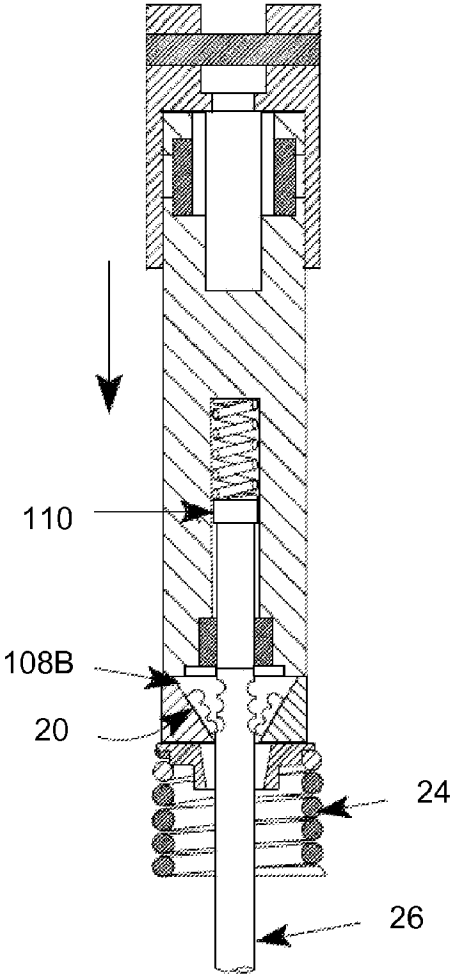

As seen in FIG. 7A and the magnified view of FIG. 7B, as downward pressure with the tool continues, the valve spring 24 compresses as the centering pin 110 moves further into the cavity 102A. Eventually, the valve spring 24 is compressed such that the ridges or mating features on the two keepers 20 in the recesses 108B are generally aligned with the annular rings 26A of the valve stem 26.

Figure 8B:
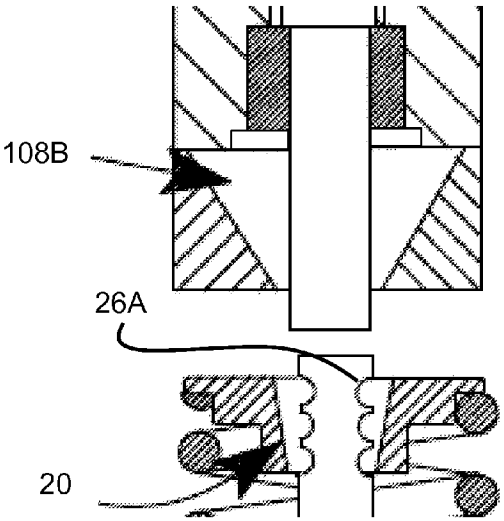
Figure 8A:
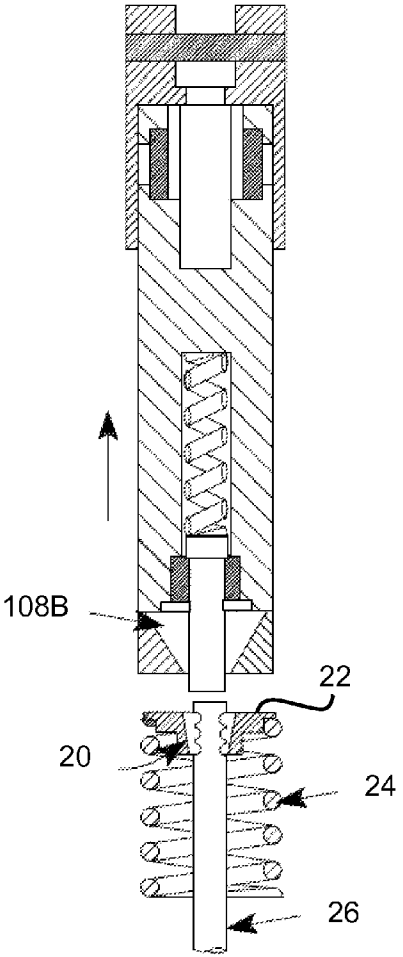

Turning to FIG. 8A and the magnified view of FIG. 8B, the tool 100 is finally moved upward. As the valve spring 24 decompresses, the keepers 20 fully engage the annular rings 26A and the spring retainer 22, thereby engaging the valve stem 26 and thereby the entire valve member with the valve spring 24.

Figure 9:
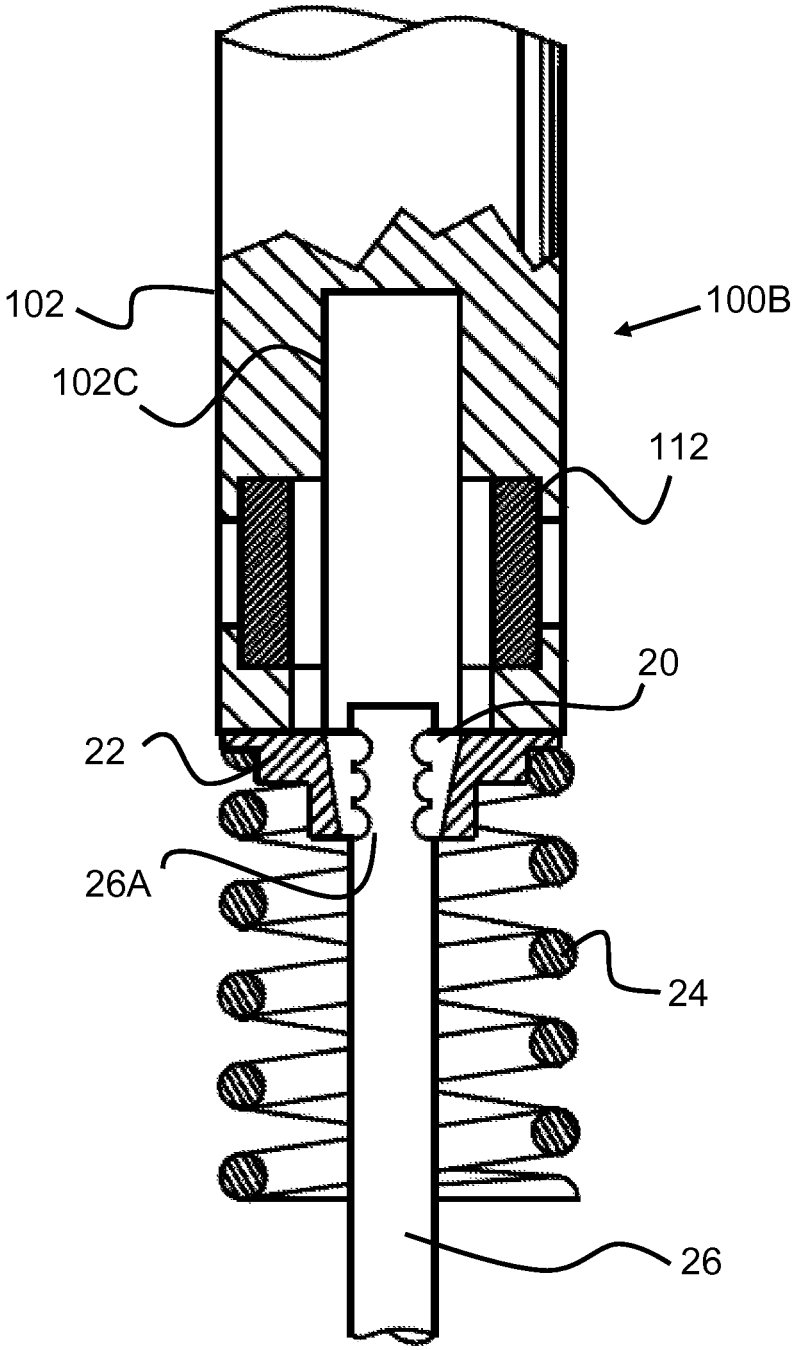
FIGS. 9-11 are various views of the valve tool of FIG. 2 during a procedure to remove valve keepers from a valve stem.
Figure 10:
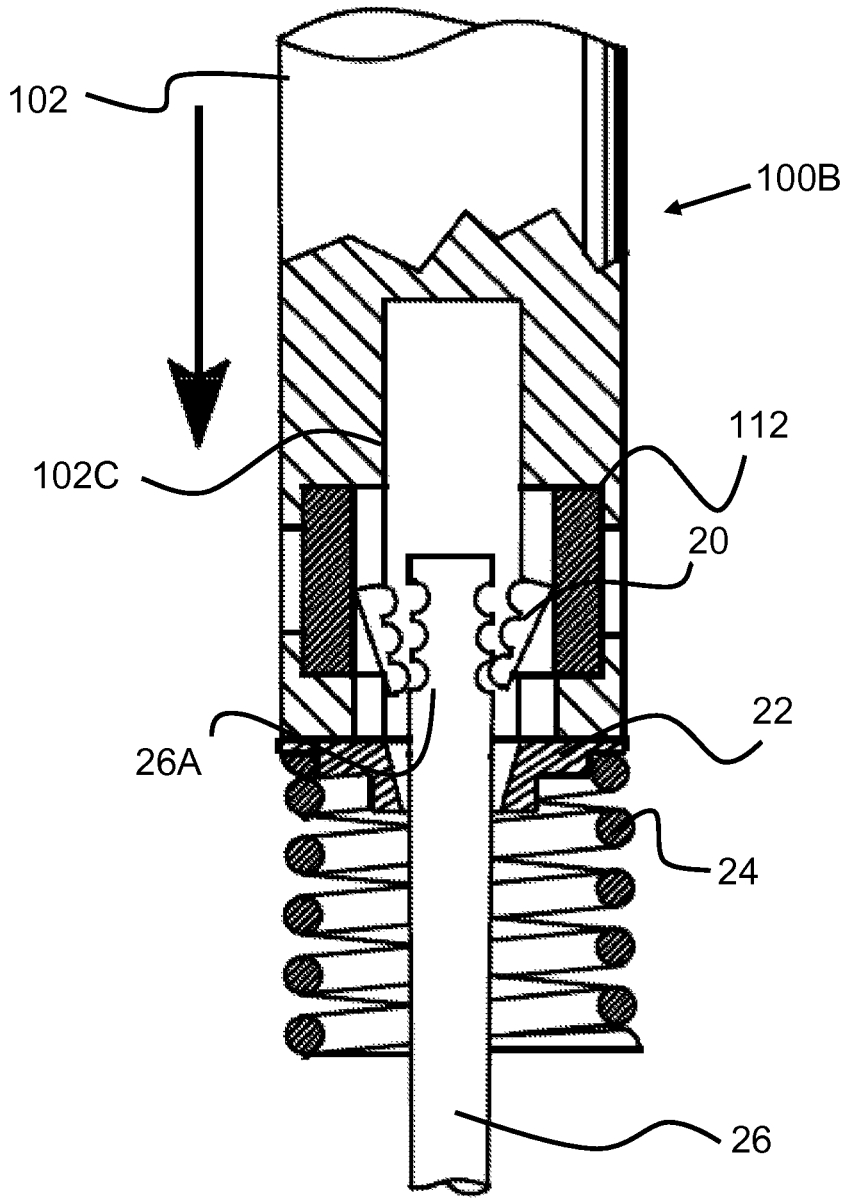
Figure 11:
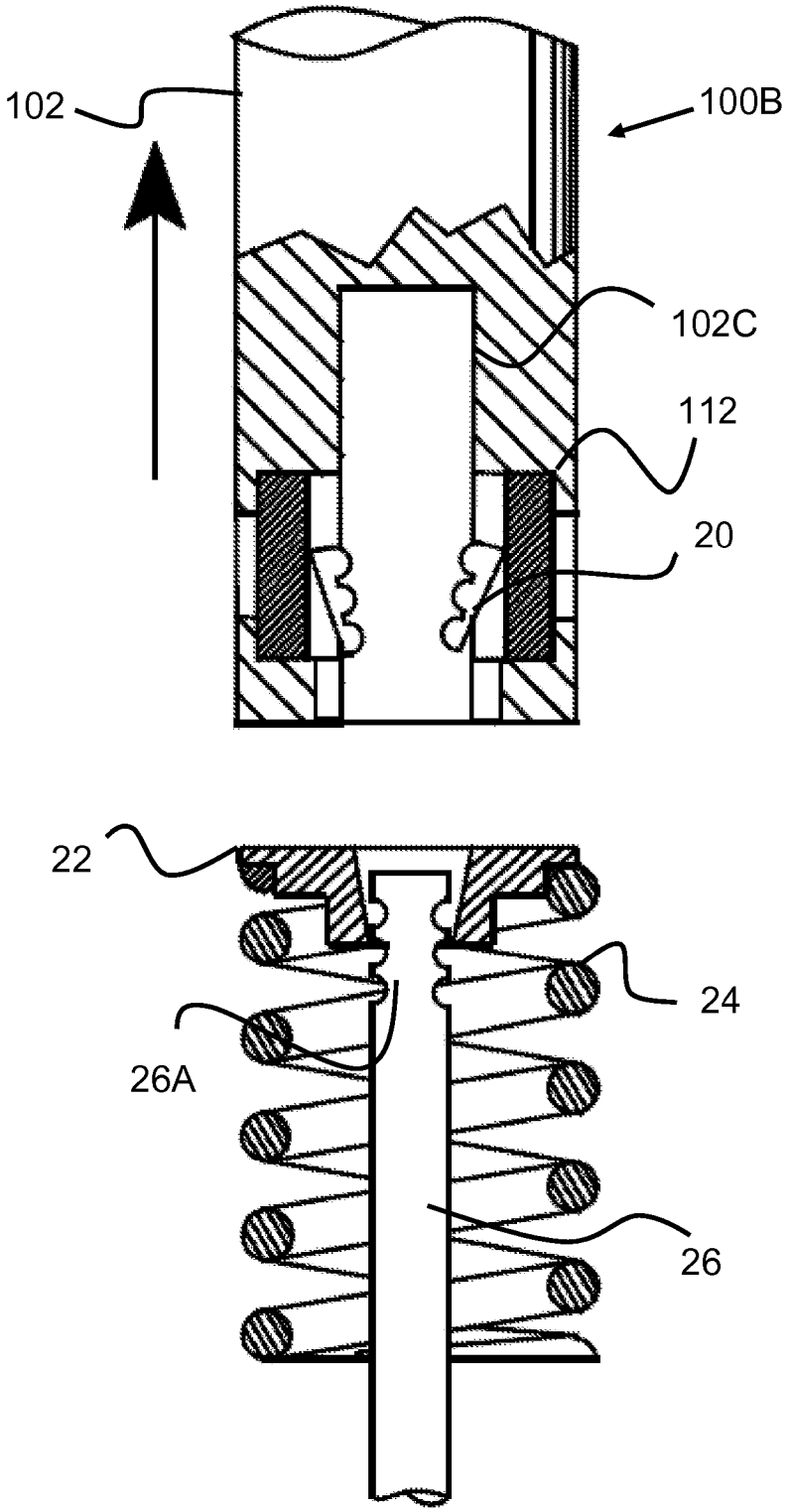

FIGS. 9-11 illustrate various steps for using the tool 100 to remove valve keepers 20 from the annular rings 26A of a valve stem 26. Referring first to FIG. 9, the lever adapter 104 is engaged over the installation end 100B of the tool 100 and connected to the lever assembly 12, as previously discussed. Next, the bottom surface of the removal end 100B of the tool 100 is located against the spring retainer 22, such that the top of the valve stem 26 is aligned with the cavity 102C. Note that the diameter of the cavity is preferably large enough to allow both the valve stem 26 and the keepers 20 to enter it.

Referring to FIG. 10, as the tool 100 is depressed, the bottom surface of the removal end 100B compresses the valve spring 24. As the downward movement continues, the keepers 20 eventually each become aligned with or adjacent to one of the magnets 112. Preferably, the magnets 112 are recessed within the cavity 102C so as to provide additional, adjacent or lateral space in the cavity between the valve stem 26 and each of the magnets 112, thereby providing space to accommodate the keepers 20 when each of the magnets 112 pull the keepers 20 from the annular rings 26A of the stem 26.

Turning to FIG. 11, the tool 100 is moved upward relative to the valve, allowing the spring 24 to decompress. In this regard, the spring retainer 22 is no longer engaged with the annular rings 26A of the valve stem 26, allowing the spring 24 and retainer 22 to be removed by the user, as well as the valve member.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A tool for installing valve keepers on a valve stem, comprising:

a tool body;

a centering pin longitudinally movable within a cavity of said tool body; and, an end portion being user-removable from an end of said tool body; said end portion having an aperture extending completely through and which the centering pin is located, and further having a discrete first and a discrete second channel that are each sized to contain a valve keeper and that terminate prior to a bottom of said end portion;

wherein said centering pin is configured to retain valve keepers in said first and said second channel when in a first position; and wherein said centering pin is configured to allow valve keepers to enter said aperture of said end portion from said first and said second channel when in a second position.

2. The tool of claim 1, wherein said centering pin is spring biased within the cavity of said tool body.

3. The tool of claim 1, wherein said centering pin further includes a recess on its distal end that is sized to engage a top of a valve stem.

4. The tool of claim 1, wherein said end portion further comprises one or more fastening pins that engage one or more fastening apertures located on a bottom of said tool body.

5. The tool of claim 1, wherein said tool has a first end configured to install said valve keepers on a valve stem and wherein said tool has a second end configured to remove said valve keepers from a valve stem.

6. The tool of claim 1, further comprising a removable lever adapter that can be engaged on a first end of said tool and on a second end of said tool.

7. The tool of claim 1, further comprising a cavity in said tool body; said cavity including a first and a second magnet that are positioned to attract valve keepers when said tool body is pressed over a valve stem.

8. The tool of claim 1, wherein said first and second channels have a semi-circular shape.

9. A tool for installing valve keepers on a valve stem, comprising:

a tool body;

a centering pin extending from a pin cavity in said tool body and being movable into and out of said pin cavity; and, an end portion being user-removable from an end of said tool body; said end portion having an aperture extending completely through and which the centering pin is located, and further having a discrete first and a discrete second channel that are each sized to contain a valve keeper and that are closed off from a bottom of said end portion;

wherein said centering pin is located within said aperture of said end portion in a first position, thereby closing said first and said second channel from said aperture; and wherein said centering pin is movable to a second position that opens said first and said second channel to said aperture of said end portion.

10. The tool of claim 9, wherein said centering pin is biased outward from said pin cavity.

11. The tool of claim 9, wherein said tool is configured to both install and remove said valve keepers on said valve stem.

12. The tool of claim 9, further comprising a magnet cavity in said tool body; said cavity including a first and a second magnet that are positioned to attract said valve keepers when said tool body is pressed over said valve stem.

13. The tool of claim 9, wherein said first and second channels have a semi-circular shape.

14. The tool of claim 9, further comprising a removable handle adapter that can be engaged on a first end of said tool and on a second end of said tool.

15. The tool of claim 9, wherein said centering pin further includes a recess on its distal end that is sized to engage a top of a valve stem.

16. The tool of claim 9, wherein said end portion is removably connected to said tool body via fastening pins.

* * * * *